US006173914B1

(12) United States Patent
Hopf et al.

(10) Patent No.: US 6,173,914 B1
(45) Date of Patent: Jan. 16, 2001

(54) VALVE AND METHOD FOR PRODUCING A VALVE SEAT FOR A VALVE

(75) Inventors: Wilhelm Hopf, Sachsenheim; Dieter Holz, Affalterbach, both of (DE)

(73) Assignee: Robert Bosch GmbH, Stuttgart (DE)

( * ) Notice: Under 35 U.S.C. 154(b), the term of this patent shall be extended for 0 days.

(21) Appl. No.: 09/242,864

(22) PCT Filed: Feb. 21, 1998

(86) PCT No.: PCT/DE98/01103

§ 371 Date: Feb. 24, 1999

§ 102(e) Date: Feb. 24, 1999

(87) PCT Pub. No.: WO99/00201

PCT Pub. Date: Jan. 7, 1999

(30) Foreign Application Priority Data

Jun. 25, 1997 (DE) ..... 197 26 991

(51) Int. Cl.[7] ..... B05B 1/30

(52) U.S. Cl. ..... 239/583; 239/584; 239/585.1; 251/359; 29/888.14; 29/890.122; 29/890.13

(58) Field of Search ..... 239/583, 584, 239/585.1, 585.3, 533.2, 533.3, 533.12; 251/359, 129.14; 29/888.44, 888.46, 890.122, 890.129, 890.13, 890.132

(56) References Cited

U.S. PATENT DOCUMENTS

| | | | |
|---|---|---|---|
| 1,629,504 | * | 5/1927 | Iversen . |
| 4,070,895 | | 1/1978 | Yamada et al. . |
| 4,826,131 | * | 5/1989 | Mikkor . |
| 4,854,024 | * | 8/1989 | Grieb et al. . |
| 5,372,313 | * | 12/1994 | Chabon et al. . |

FOREIGN PATENT DOCUMENTS

| | | |
|---|---|---|
| 42 21 185 | 1/1994 | (DE) . |
| WO 89/05914 | 6/1989 | (WO) . |

* cited by examiner

*Primary Examiner*—Andres Kashnikow
*Assistant Examiner*—Christopher S. Kim
(74) *Attorney, Agent, or Firm*—Kenyon & Kenyon

(57) ABSTRACT

A valve includes an orifice disk element having at least two sheet metal layers lying in sandwich fashion against one another. The orifice disk element includes at least a base region with the opening geometry necessary for spray discharge of the medium, and a seat region with a valve seat surface, so that the valve seat and orifice disk function are combined in one metal laminate element. The valve is suitable in particular for use in fuel injection systems of mixture-compressing, spark-ignited internal combustion engines.

31 Claims, 6 Drawing Sheets

VALVE AND METHOD FOR PRODUCING A VALVE SEAT FOR A VALVE

FIELD OF THE INVENTION

The present invention relates to a valve and a method for manufacturing a valve seat for the valve.

BACKGROUND INFORMATION

German Patent Application No. 42 21 185 describes an injection valve for injecting fuel into an intake manifold in which the valve seat element is manufactured using a chip-removing production method. After the chip-removing premachining, the valve seat element must be subjected, in the region of the valve seat, to a subsequent microfinishing operation in order to achieve the accuracy in coaction with a spherically configured valve closure element that is necessary for the sealing function. A separately produced perforated spray disk is sealingly joined, by welding, to the valve seat element at its downstream end face. The action of heat during welding can disadvantageously result in an undesired deformatcion of the perforated spray disk. For this two-part valve seat part, it is necessary to manufacture two components separately from one another, which are only subsequently joined to one another and optionally must also be post-processed together, resulting overall in a relatively high production outlay.

SUMMARY OF THE INVENTION

The valve according to the present invention, has the advantage that the valve seat and orifice disk functions are integrated in simple fashion into one single component; an orifice disk element of this kind can be manufactured in a particularly easy, economical, and material-saving manner by series production in large volumes. The configuration of the orifice disk element with several functional regions as a metal laminate element results not only in easy machinability and low weight due to the reduction in components, but also to a decrease in material consumption. It is also possible to dispense with joins between the valve seat element and orifice disk, for example weld beads, thus achieving an economy of material and time and avoiding sealing problems.

The multilayer construction of the orifice disk element from metal sheets arranged in sandwich fashion allows the opening geometry to be configured in such a way that uniform ultrafine atomization of the medium being sprayed out is attained without additional energy, achieving a particularly high atomization quality and spray shaping adapted to the particular requirements. In particularly advantageous fashion, an S-bend in the flow of the medium, for example a fuel, is achieved.

Advantageously, the orifice disk element possesses functional regions for spraying out the medium and influencing its flow (base region), for opening and closing the valve (seat region), for guiding the axially movable valve closure element (guidance region), and for mounting in the valve (retaining region). A single valve component thus performs a plurality of functions.

The S-bend in the flow attained via the geometrical arrangement of the opening geometry (offset between spray discharge openings and inlet opening) allows the configuration of bizarre spray shapes with a high atomization quality. For one-, two-, and multi-stream sprays, the orifice disk elements make possible spray cross sections in innumerable variants, for example rectangles, triangles, crosses, ellipses. Unusual spray shapes of this kind allow precise, optimal adaptation to predefined geometries, for example to different intake manifold cross sections of internal combustion engines. This results in the advantages of geometrically adapted utilization of the available cross section for homogeneously distributed, emissions-reducing mixture introduction, and avoidance of emissions-promoting wall film deposits on the intake manifold wall. With a valve of this kind, it is consequently possible to reduce the exhaust emissions of the internal combustion engine and also to decrease fuel consumption.

Generally, it is to be regarded as a very significant advantage of the valve according to the present invention that spray pattern variations are easily possible.

It is particularly advantageous to provide flow openings in the guidance region of the orifice disk element, so that unimpeded flow of the medium toward the valve seat is made possible. Advantageously, these flow openings have an orientation such that a medium flowing through them has a swirl imparted to it.

The methods according to the present invention for manufacturing a valve seat for a valve, have the advantage that when they are used, multilayer orifice disk elements can easily and economically be manufactured from metal in very large volumes (line production). Particularly advantageously, a simple and economical positional allocation of individual metal foils or of the sheet metal layers of the later orifice disk elements can be implemented using auxiliary openings, so that production reliability is very high. Preferably the positional allocation of the metal foils is accomplished automatically by optical scanning and image analysis. The material, metal thickness, desired opening geometries, and further parameters can very easily be ideally adapted for the particular application on machines and automated equipment provided for the manufacture of multilayer orifice disk elements.

Advantageously, the rounds that are first present in a band and are later isolated are reshaped so as to form orifice disk elements which have at least one base region with the opening geometry, and a seat region with a valve seat surface. The orifice disk elements comprising several sheet metal layers thus combine the valve seat and orifice disk functions in one component.

It is particularly advantageous to make the metal foils available for further processing in the form of foil strips or foil carpets.

Welding, soldering, or adhesive bonding, in all their various forms of application, ideally serve as joining methods to be used optionally for joining several metal foils within or outside the rounds.

In particularly advantageous fashion, isolation of the rounds is accomplished with a cutting tool of a deep drawing tool, in which reshaping of the rounds into cup-shaped orifice disk elements is also performed.

Advantageously, that metal layer of the seat region of the orifice disk element which faces the valve closure element is hardened.

DETAILED DESCRIPTION

Figure 1:
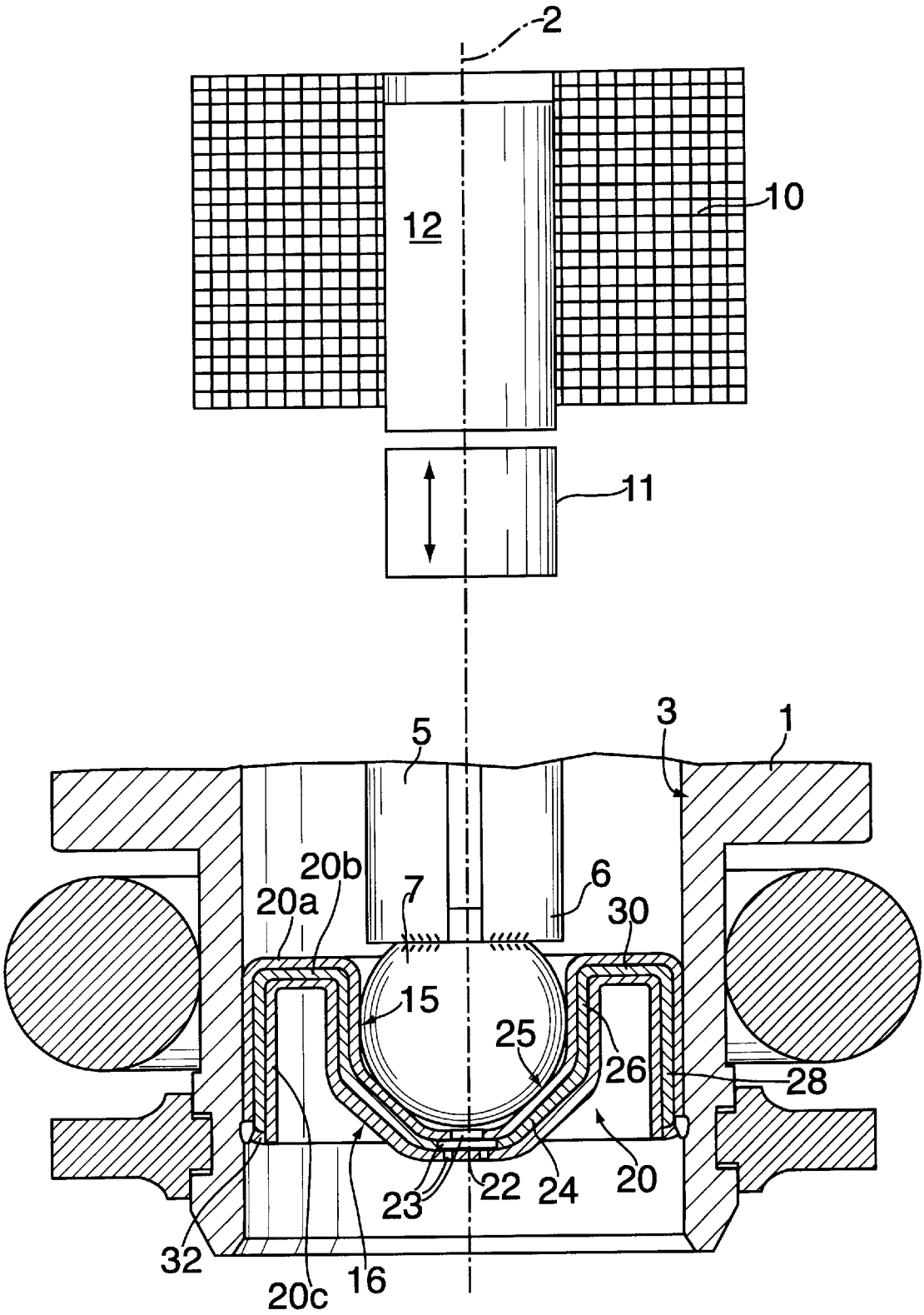
FIG. 1 shows a partially depicted injection valve having a first orifice disk clement according to the present invention.

FIG. 1 partially depicts, as an exemplary embodiment, a valve in the form of an injection valve for fuel injection systems of mixture-compressing, spark-ignited internal combustion engines. The injection valve has a tubular valve seat support 1 in which a longitudinal opening 3 is configured concentrically with a longitudinal valve axis 2. Arranged in longitudinal opening 3 is a, for example, tubular valve needle 5, which is joined at its downstream end 6 to a, for example, spherical valve closure element 7.

Actuation of the injection valve is performed in a conventional manner, for example electromagnetically. A schematically indicated electromagnetic circuit having a magnet coil 10, an armature 11, and a core 12 serves to move valve needle 5 axially, and thus to open the injection valve against the force of a return spring (not depicted) or to close it. Armature 11 is joined, for example using a weld bead produced with a laser, to the end of valve needle 5 facing away from valve closure element 7, and is aligned on core 12.

A guide opening 15 of an orifice disk element 16 serves to guide valve closure element 7 during the axial movement. Orifice disk element 16 is hermetically mounted, by welding, into the downstream end of valve seat support 1 facing away from core 12, in longitudinal opening 3 which runs concentrically with longitudinal valve axis 2. Orifice disk element 16 represents a combination of an orifice disk and a valve seat element of ordinary valves, in particular fuel injection valves, and thus simultaneously performs the functions of both components that would otherwise be used. Orifice disk element 16 is formed by at least two, in the exemplary embodiment according to FIG. 1 by three, thin sheet metal layers 20, thus creating a so-called metal laminate orifice disk which also functions as a valve seat.

Orifice disk element 16 is manufactured from several planar metal foils which are deformed, for example by deep drawing or cupping, in such a way that differently oriented regions of orifice disk element 16 are created. Orifice disk element 16 thus has at least one central base region 22 with a desired opening geometry 23; a seat region 24, adjacent radially outward, having an inner valve seat surface 25; a guidance region 26 following that, with the inner guide opening 15; and an outer retaining region 28 forming the radial termination. Optimally, there can also be provided between guidance region 26 and retaining region 28 a connecting region 30 which, for example as in FIG. 1, runs parallel to base region 22 and perpendicular to longitudinal valve axis 2. Except for base region 22, all the other regions 24, 26, 30, 28 extend annularly around valve closure element 7. Retaining region 28, slightly bent conically outward, exerts a radial spring action on the wall of longitudinal opening 3. This prevents any formation of chips on longitudinal opening 3 when orifice disk element 16 is inserted into longitudinal opening 3 of valve seat support 1. Retaining region 28 of orifice disk element 16 is joined at its free end to the wall of longitudinal opening 3, for example using a circumferential and hermetic weld bead 32. The hermetic weld prevents fuel from flowing through in longitudinal opening 3 directly into an intake duct of the internal combustion engine.

The insertion depth into longitudinal opening 3 of orifice disk element 16 serving as the valve seat part determines the magnitude of the stroke of valve needle 5, since the one end position of valve needle 5, when magnet coil 10 is not energized, is defined by contact of valve closure element 7 against valve seat surface 25 of seating region 24. The other end position of valve needle 5, when magnet coil 10 is energized, is defined, for example, by contact of armature 11 against core 12. The distance between these two end positions of valve needle 5 thus represents the stroke.

The spherical valve closure element 7 cooperates with valve seat surface 25, tapering frustoconically in the flow direction, of seat region 24 of orifice disk element 16, which is configured in the axial direction between guidance region 26 and base region 22. Guidance region 26, seat region 24, and base region 22 together form an inner cup of orifice disk element 16 which largely receives and encloses the spherical valve closure element 7.

Figure 2:
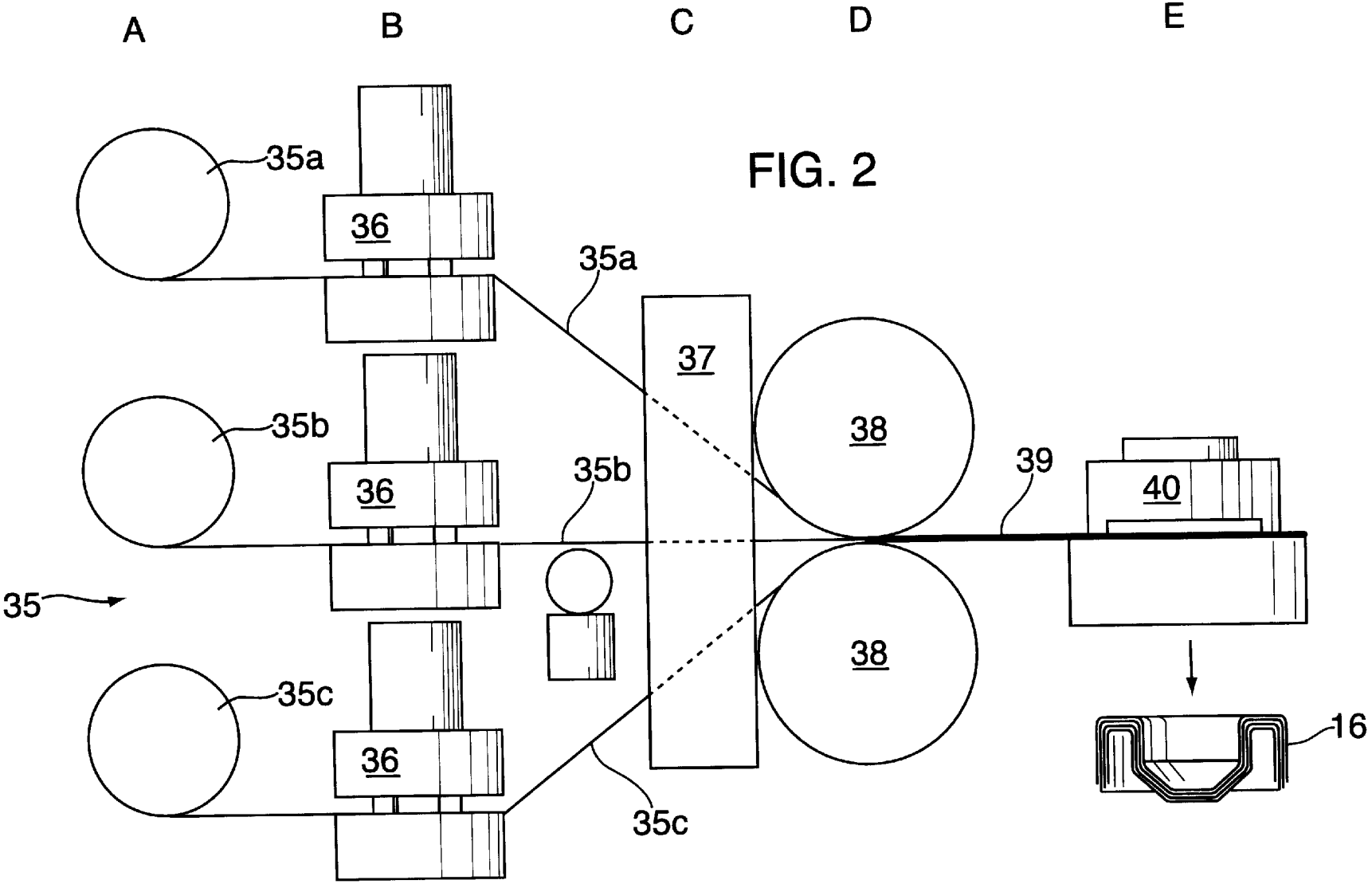
FIG. 2 shows a schematic illustration of a process sequence during manufacture of an orifice disk element.

FIG. 2 shows a schematic diagram of the process sequence for manufacture of an orifice disk element 16 according to the present invention, the individual production and processing stations being depicted merely schematically. Individual processing steps will be explained in more detail with reference to the subsequent Figures. In the first station designated A, metal foils in the form, for example, of rolled-up foil strips 35, are present in accordance with the desired number of sheet metal layers 20 of the later orifice disk element 16. When three foil strips 35*a*, 35*b*, and 35*c* are used to manufacture a metal laminate orifice disk element 16 having three sheet metal layers 20, it is preferable for later processing, especially during joining, to coat middle foil strip 35*b*. Identical opening geometries 23, as well as auxiliary openings 54, 55 (FIG. 3) for centering and aligning foil strips 35 and for later removal of orifice disk elements 16 from foil strips 35, are subsequently introduced into foil strips 35 in large quantities in each foil 35.

Figure 3:
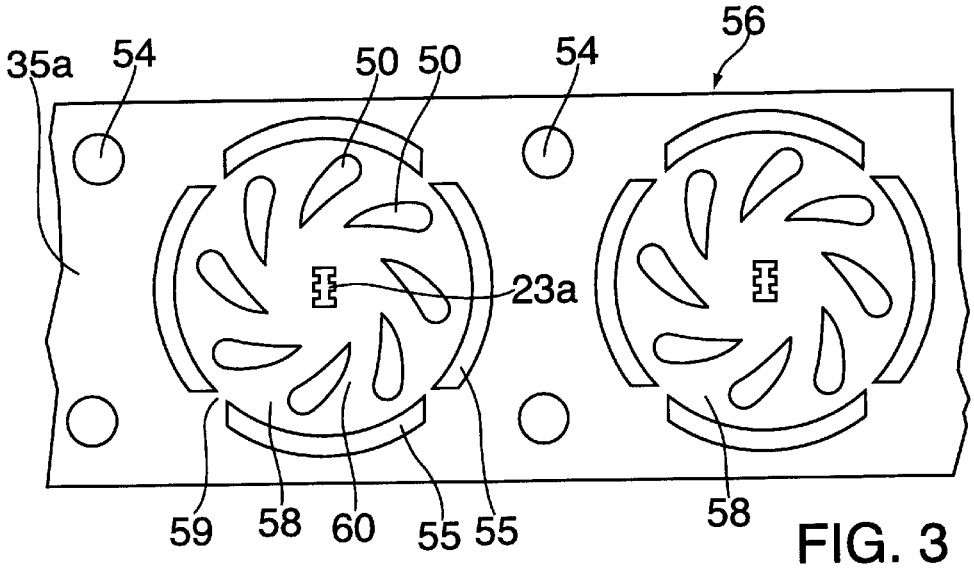
FIG. 3 shows an exemplary embodiment of a foil strip for a later metal layer of an orifice disk element.

This processing of the individual foil strips 35 occurs in station B. Provided in station 2 are tools 36 with which the desired opening geometries 23 and auxiliary openings 54, 55 are shaped into the individual foil strips 35. In this context, all the essential contours are manufactured by micropunching, laser cutting, electrodischarge machining, etching, or comparable methods. In addition to opening geometries 23 and auxiliary openings 54, 55, flow openings 50 (FIG. 3) are also introduced into the upper foil strips 35*a*. FIG. 3 illustrates an example of a foil strip 35*a* processed in this fashion. Foil strips 35 processed in this fashion pass through station C, which represents a heating device 37 in which foil strips 35 are, for example, inductively heated in preparation for a soldering operation. Station C is provided only optionally, since other joining methods not requiring heating can also be used at any time to join foil strips 35.

Joining of the individual foil strips 35 to one another is accomplished in station D, foil strips 35 being accurately positioned with respect to one another with the aid of centering mechanisms and, for example using rotating pressure rollers 38, pressed together and transported on. A centering mechanism (index pins, index pegs) engages into auxiliary openings 54, ensuring that rounds 58 of the individual foil strips 35 are brought onto one another in dimensionally accurate and positionally secure fashion before foil strips 35 are joined to one another. Laser welding, light beam welding, electron beam welding, ultrasonic welding, pressure welding, induction soldering, laser beam soldering, electron beam soldering, adhesive bonding, or other known methods can be used as joining methods. The permanent joins between foil strips 35 can be performed both inside rounds 58, (e.g. in the region of the later seat region 24) and outside rounds 58 near foil edges 56 or in central regions of band 39 between each two opposite auxiliary openings 54.

Subsequent to this, band 39 comprising several layers of foil strips 35 is processed in station E in such a way that orifice disk elements 16 are present in the size and contour desired for installation in the injection valve. Isolation of orifice disk elements 16 also takes place in station E, for example by punching them out of band 39 or by breaking them away in a tool 40, in particular a deep drawing tool. Orifice disk elements 16 are, for example, separated out from band 39 by breaking and thus isolated, orifice disk elements 16 being at the same time directly given a cup-shaped configuration. If punching is performed in a manner other than in a deep drawing tool, a deep drawing operation or cupping is additionally necessary after punching.

Installation of orifice disk elements 16 in valve seat support 1 is subsequently also accomplished. Orifice disk elements 16 are mounted with the aid of a fitting apparatus (not depicted), a laser welding device preferably being used to achieve a permanent and hermetic join.

A concrete exemplary embodiment of a foil strip 35*a* for an orifice disk element 16 is shown in FIG. 3. In this, foil strip 35*a* represents upper metal layer 20*a* which later faces toward valve closure element 7. For metal laminate orifice disk elements 16, two to five foil strips, each having a thickness of 0.05 mm to 0.3 mm, in particular approx. 0.1 mm, are usually arranged one above another. Each foil strip is equipped in station B with an opening geometry 23 which repeats in large numbers over the length of foil strip. In the exemplary embodiment depicted in FIG. 3, upper foil strip 35*a* has an opening geometry 23 in the form of a double-H-shaped inlet opening 23*a*. At the same time, openings such as passthrough openings 23*b* or spray discharge openings 23*c*, with respectively different opening contours, are shaped into the other foil strips. In addition to opening geometries 23, flow openings 50 and auxiliary openings 54 and 55 are introduced in station B.

Between each two adjacent opening geometries 23 that are introduced, auxiliary openings 54 are shaped in at equal distances near foil edges 56 as centering openings, which can be polygonal or circular in accordance with the shape of the tools or auxiliaries later engaging there. Auxiliary openings 54 can also be provided as groove-like centering and feed recesses, directly on foil edges 56. Other auxiliary openings 55 are provided in foil strips as sickle-shaped openings surrounding the respective opening geometries 23 and, in upper metal layer 20*a*, flow openings 50. The, for example, four sickle-shaped auxiliary openings 55 enclose with their inner contour a circle having a diameter with which the size of orifice disk element 16 is defined. The circular regions in foil strips 35*a* enclosed by auxiliary openings 55 are referred to as rounds 58. Auxiliary openings 55 taper to a point at their ends, narrow webs 59 being formed between the individual auxiliary openings 55 and possessing, in the region of the round diameter, a width of only 0.2 to 0.3 mm. Webs 59 break during punching or deep drawing in station E, causing orifice disk elements 16 to be detached. In particularly effective fashion, several foil strips can also be combined into a larger foil carpet, on which rounds 58 are arranged in two dimensions.

While only the central opening geometries 23*b*, 23*c* and auxiliary openings 54, 55 are shaped into foil strips 35*b*, 35*c* which have sheet metal layers 20*b*, 20*c* that later face away from valve closure element 7, upper metal layer 20 which faces toward valve closure element 7 additionally has flow openings 50 introduced into it. Flow openings 50 are, for example, embodied in teardrop shape and annularly surround inner inlet opening 23*a*. The individual flow openings 50 do not extend exactly radially toward the center point of the round, but rather have a certain degree of twist. A swirl component can thus very easily be impressed upon a medium flowing through. The obliquity of flow openings 50 determines the swirl of the flow. Flow openings 50 can, of course, also be introduced in such a way that a medium flowing through them arrives at seat region 24 or base region 22 radially and with no swirl imparted to it. In the completely shaped orifice disk element 16, flow openings 50 are located in guidance region 26, as illustrated very clearly by FIGS. 4 and 5. The material regions of upper metal layer 20*a* remaining between flow openings 50 represent narrow, web-like guide surfaces for guiding valve needle 5 or valve closure element 7. Because flow openings 50 are provided in orifice disk element 16, it is advantageously possible to dispense entirely with the introduction of flattened areas, grooves, or conduits on valve closure element 7 to allow a flow of medium.

Figure 4:
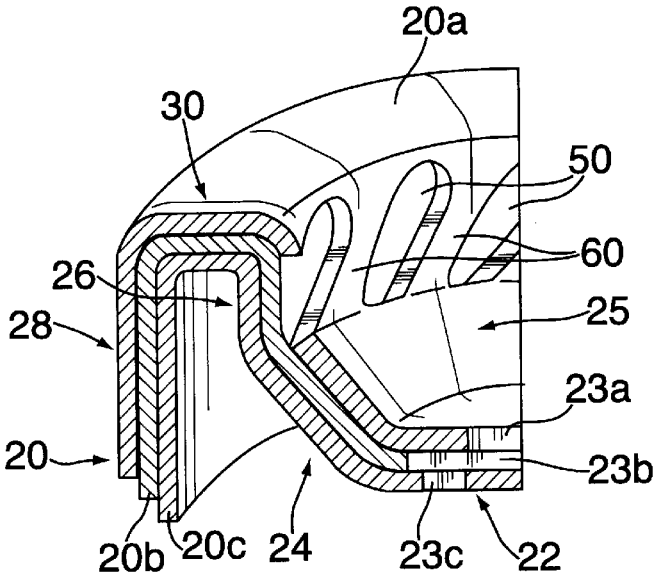
FIG. 4 shows portions of an exemplary embodiment of orifice disk elements having differently shaped retaining regions.
Figure 5:
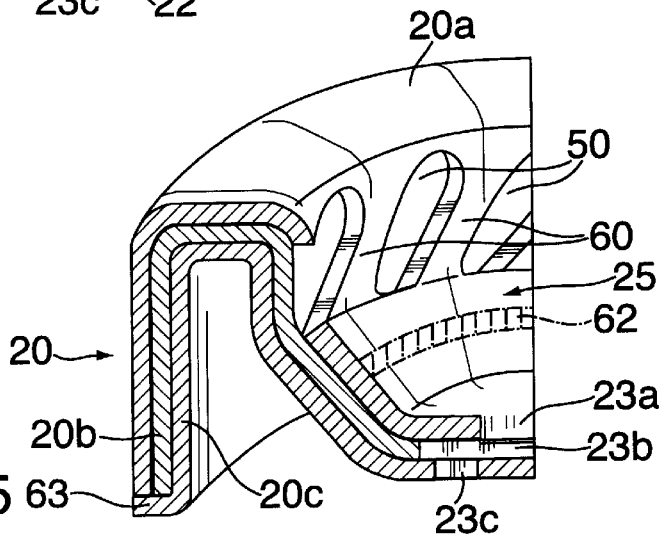
FIG. 5 shows portions of another exemplary embodiment of orifice disk elements having differently shaped retaining regions.

FIGS. 4 and 5 show portions of two examples of orifice disk elements 16, all regions 22, 24, 26, 28, and 30 being at least partially visible. At least upper metal layer 20*a* should be made of a hardenable material so that valve seat surface 25 of seat region 24 can be hardened after deep drawing. This can be accomplished, for example, annularly in a circumferential strip 62, as indicated in FIG. 5. Hardening can also be performed, however, over a larger area. Induction hardening, pulsed induction hardening, laser beam hardening, and electron beam hardening are particularly suitable. Hardening can be entirely dispensed with if the work-hardening resulting from reshaping is already sufficient. Microfinishing of valve seat surface 25 of seat region 24 is performed, for example, such that valve closure element 7 of the original valve needle 5 is equipped with a thin, slightly abrasive, ideally soluble layer with which the valve seat is "ground in." The applied layer is then dissolved (under pressure) and flushed out. Crystalline layers of salt, soda, or the like, which can be completely dissolved and flushed out, are ideal. Microfinishing of guide surfaces 60 of guidance region 26 is accomplished, for example, by gauged stamping.

As a result of deep drawing or cupping of rounds 58 in station E, the inner cup and outer retaining rim of orifice disk element 16 are formed in the desired manner. If the round diameter is selected to be of identical size in the individual foil strips, deep drawing of sheet metal layers 20 then creates retaining region 28 which is set back at its free end. Inner metal layer 20*c* of retaining region 28, which proceeds out of lower foil strip 35*c*, terminates (viewed in the downstream direction) farthest away from joining region 30, while all the other sheet metal layers 20, from inside to outside, each end up being shorter because of the deep drawing process. The diameters of rounds 58 can, however, also be defined a priori as being of a different size, so that after deep drawing, for example, outer sheet metal layers 20 of retaining region 28 terminate in a single plane at the free end, and inner metal layer 20*c* of retaining region 28 stops farther downstream. The projecting end 63 of metal layer 20*c* can be folded under the other metal layer ends, for example by bending or crimping (FIG. 5), so that easier mounting, for example on valve seat support 1 by way of weld bead 32, can be achieved.

Figure 6:
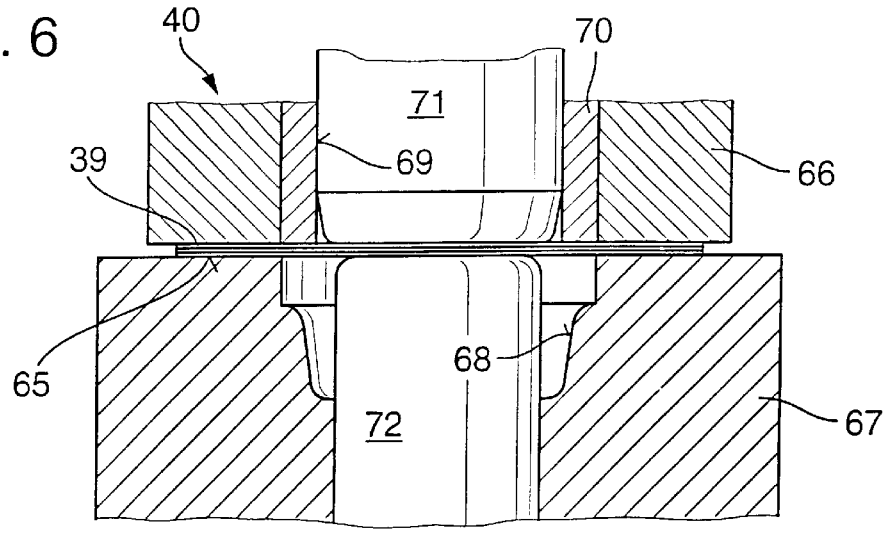
FIG. 6 shows a deep drawing tool having a strip to be processed in a particular stage of processing.
Figure 7:
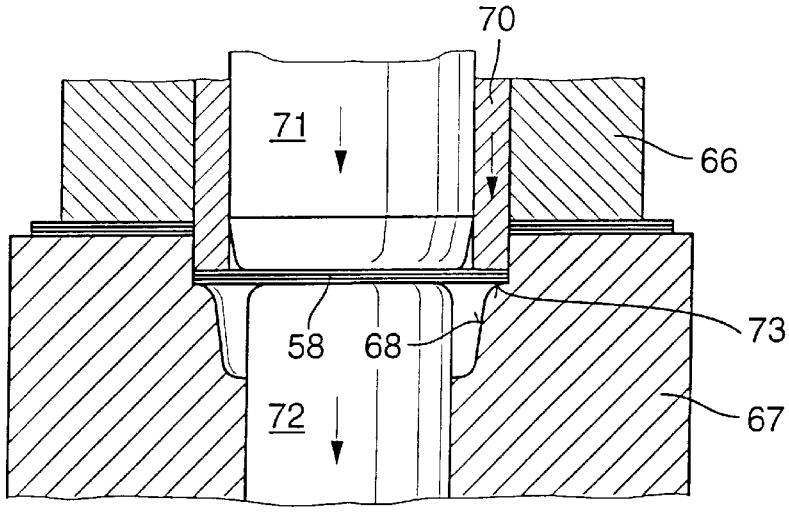
FIG. 7 shows a deep drawing tool having a strip to be processed in another stage of processing.
Figure 8:
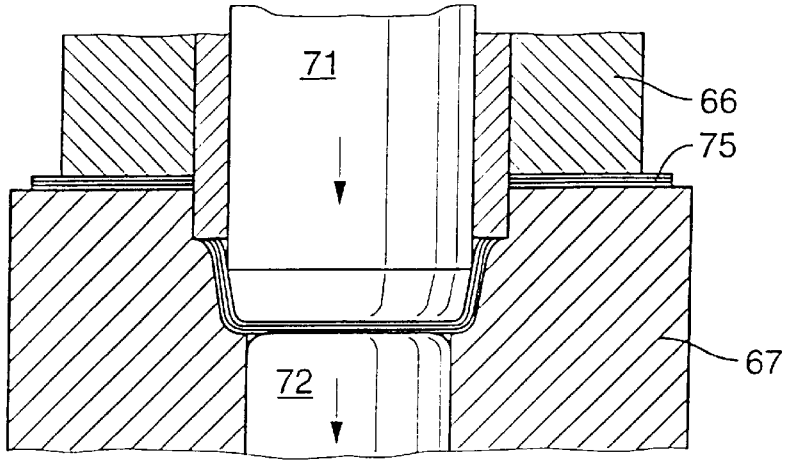
FIG. 8 shows a deep drawing tool having a strip to be processed, in a further stage of processing.

FIGS. 6 through 8 schematically depict, in simplified fashion, deep drawing tool 40 through which band 39 passes. Band 39 rests, with its edge regions outside auxiliary openings 55 close to foil edges 56, for example on a workpiece support surface 65, against which it is pressed by a holddown 66. Workpiece support surface 65 belongs to a die 67 as part of deep drawing tool 40. Die 67 has an at least partially frustoconical or curved opening 68 which performs the actual die function to reshape rounds 58 into orifice disk elements 16. Also provided in holddown 66 is an opening 69 which is defined by the inner wall of a sleeve-shaped cutting tool 70. A punch 71 is arranged movably perpendicular to the plane of band 39 in largely cylindrically configured opening 69, and is surrounded by the also movable cutting tool 70. On the side of band 39 located opposite punch 71 there is provided in the partially curved but also partially cylindrical opening 68 of die 67 a punch counterelement 72 which follows the movement of punch 71, the cylindrical segment of opening 68 serving to guide punch counterelement 72.

Cutting tool 70 moves together with punch 71 perpendicular to the plane of band 39, as indicated by the arrows in FIG. 7. Because of the precisely centered and defined movement of punch 71 and cutting tool 70 toward punch counterelement 72 in opening 68 of die 67, with a high level of surface pressure and with a force which is greater than the counterforce of punch counterelement 72, round 53 is cut very exactly out of band 39 by an edge of cutting tool 70. Cutting tool 70 comes to a halt against a step 73 of opening 68 in die 67, simultaneously ensuring immobilization of round 58 during the subsequent deep drawing operation. As the procedure continues (FIG. 8), punch 71 is simply moved into opening 68 so that round 58 is brought into a first cup-shaped configuration which can already be the cup-shaped orifice disk element 16. For complete configuration of all the regions 22, 24, 26, 28, and 30 of orifice disk element 16, however, it is often necessary to perform several reshaping operations in different tools which are configured similarly to tool 40 depicted in FIGS. 6 through 8. These processes taking place in station E are, in addition to cutting, a translational compression-tension forming operation, such as deep drawing or cupping. Bending methods can additionally be used.

A foil edge 75 broken off from round 58 remains behind in deep drawing tool 40 as waste, but it can be recycled and used for the manufacture of new metal foils. Permanent joining of foil strips in station D can be completely dispensed with if deep drawing or cupping in station E generates retaining region 28 of orifice disk element 16 in sharply bent-over form, for example almost perpendicular to base region 22 (as shown in FIG. 1), i.e. thereby creating sufficiently permanent joins in the bending regions.

Figure 9:
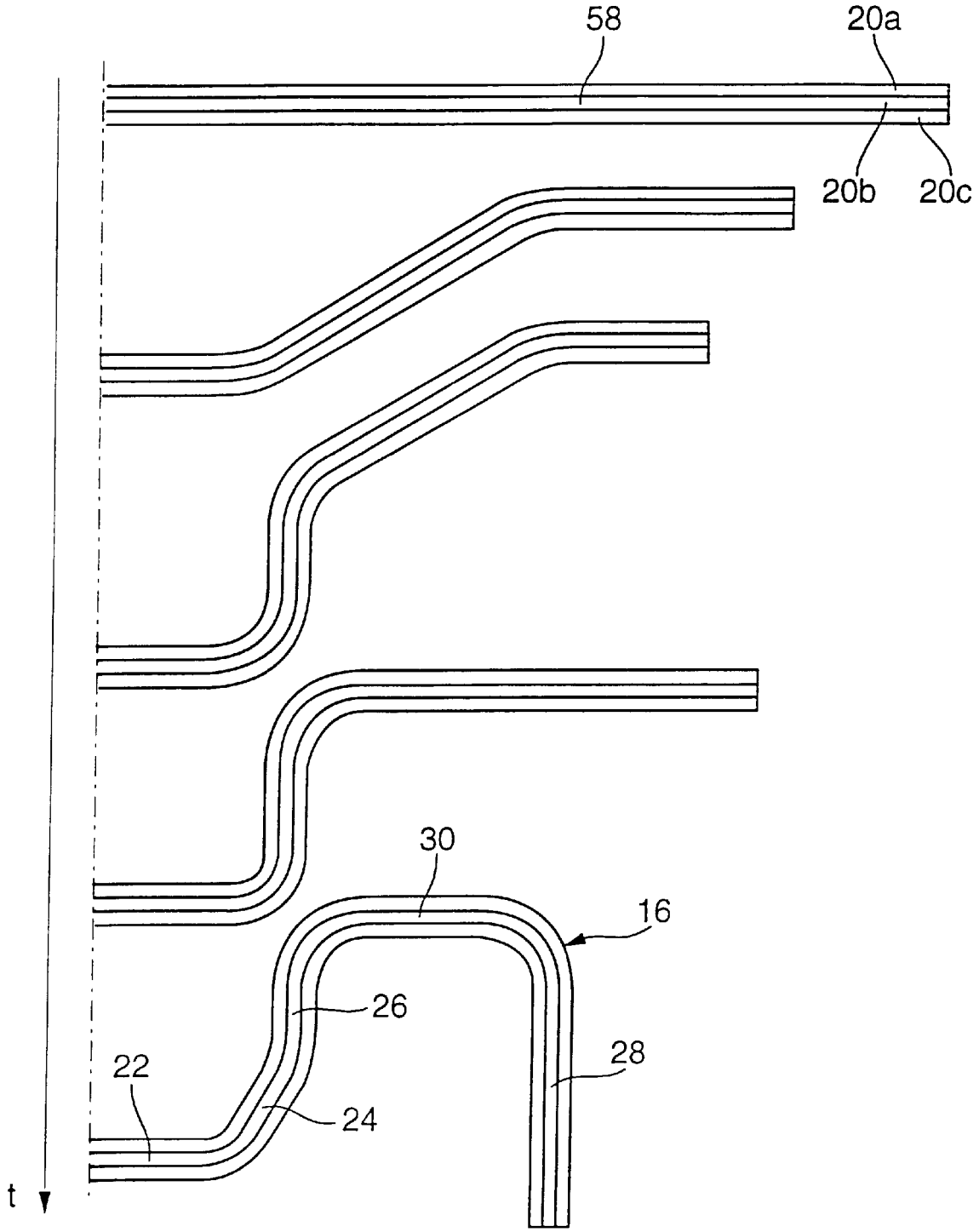
FIG. 9 shows a time sequence for reshaping of a round into an orifice disk element.

FIG. 9 depicts an exemplary embodiment of a time sequence in the reshaping of a round 58 into an orifice disk element 16. It is evident that several deep drawing or bending operations are needed in order to obtain a desired shape for orifice disk element 16 with regions 22, 24, 26, 28, and 30. The reshaping operations on round 58 can also be performed in a sequence different from the one shown in FIG. 9.

As shown in FIGS. 4 and 5, it is advantageous to shape spray discharge openings 23*c* with an offset with respect to inlet opening 23*a*, so that in projection, inlet opening 23*a* does not overlap spray discharge openings 23*c* at any point. The offset can be of different magnitudes in different directions. Passthrough opening 23*b* is configured as a conduit (cavity) connecting inlet opening 23*a* to spray discharge openings 23*c*. This configuration of opening geometry 23 in base region 22 of orifice disk element 16 leads to a so-called S-bend in the flow of the medium, especially of the fuel.

Because of the S-bend inside orifice disk element 16, with several extreme flow deflections, a high level of atomization-promoting turbulence is impressed upon the flow. The velocity gradient transverse to the flow is thereby particularly pronounced. It is an expression of the change in velocity transverse to the flow, the velocity in the center of the flow being much higher than in the vicinity of the walls. The elevated shear stresses in the fluid resulting from the velocity differences promote breakdown into fine droplets close to spray discharge openings 23*c*. Since the flow in the outlet is detached on one side due to the impressed radial component, it experiences no flow calming due to the lack of contour guidance. The fluid has a particularly high velocity at the detached side. The atomization-promoting shear turbulence is thus not abolished at the outlet.

Among the results of the transverse momentum transverse to the flow that is present due to the turbulence is the fact that the droplet distribution density in the discharged spray is highly uniform. This results in a decreased probability of droplet coagulation, i.e. the combination of small droplets into larger droplets. The consequence of the advantageous reduction of the average droplet diameter in the spray is a relatively homogeneous spray distribution. The S-bend generates in the fluid a fine-scale (high-frequency) turbulence which causes the stream to break down into correspondingly fine droplets immediately after emerging from orifice disk element 16.

Figure 10:
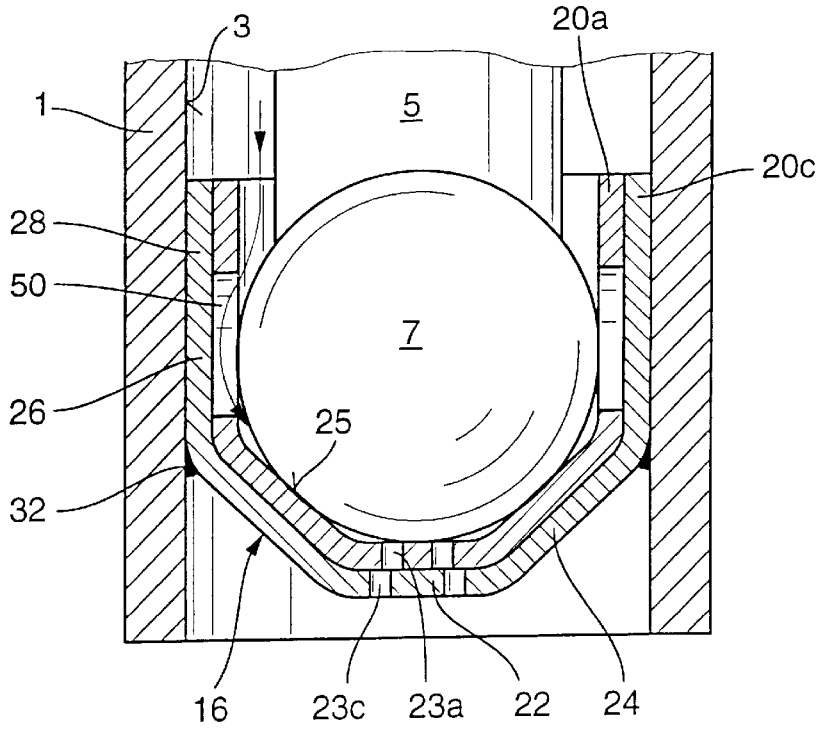
FIG. 10 shows an exemplary embodiment of a two-layer orifice disk element.
Figure 11:
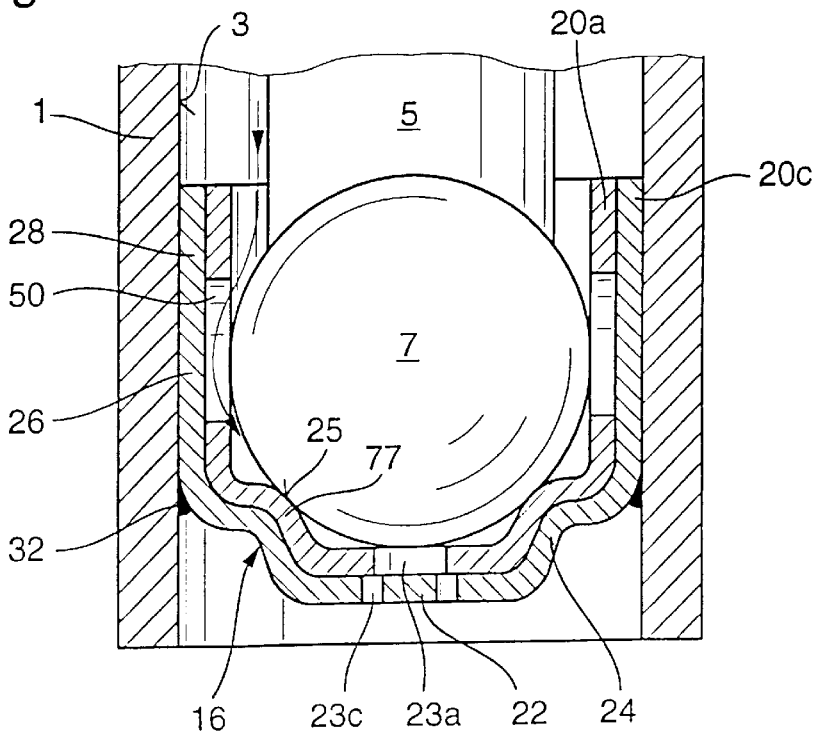
FIG. 11 shows another exemplary embodiment of a two-layer orifice disk element.

FIGS. 10 and 11 depict two examples of simple two-layer orifice disk elements 16 according to the present invention, 10 in which parts that remain identical or function identically to those depicted in FIG. 1 are labeled with identical reference characters. Orifice disk element 16 in FIG. 10 has two sheet metal layers 20*a* and 20*c*, which were reshaped from round 58 in such a way that the central base region 22 with opening geometry 23, seat region 24 with valve seat surface 25, and guidance region 26 with flow openings 50, are provided. These three regions 22, 24, and 26 in turn together form a cup. Guidance region 26, however, also simultaneously serves as retaining region 28; a joining region 30 is not provided at all. Guidance region 26 thus already rests, with its metal layer 20*c* facing away from valve closure element 7, against the wall of valve seat support 1 in longitudinal opening 3. A permanent join between orifice disk element 16 and valve seat support 1 is achieved by way of weld bead 32, which is applied on valve seat support 1, for example, in the angled transition of guidance region 26 and seat region 24. Inlet openings 23*a* of metal layer 20*a* have a partial offset with respect to spray discharge openings 23*c* of metal layer 20*c*.

In contrast to orifice disk element 16 in FIG. 10, the exemplary embodiment shown in FIG. 11 has a differently configured seat region 24. Seat region 24 is equipped, emerging from its frustoconical contour, with a ridge 77 which is oriented toward valve closure element 7 and which has, on metal layer 20*a* facing valve closure element 7, the annularly peripheral valve seat surface 25. Advantageously, ridge 77 also serves to stiffen orifice disk element 16. The introduction of ridge 77 also simplifies the application of weld bead 32, since tool access in the joining region is made easier.

What is claimed is:

1. A valve comprising:

an orifice disk element having at least one spray discharge opening, the orifice disk element further having a first sheet metal layer and a second sheet metal layer situated in a sandwich manner against one another, the orifice disk element having a seat region formed of the first sheet metal layer and the second sheet metal layer which are deflected, the deflected first sheet metal layer forming a fixed valve seat; and a valve closure element cooperating with the valve seat and being axially movable along a longitudinal valve axis of the valve.

2. The valve according to claim 1, wherein the valve is a fuel injection valve for a fuel injection system of an internal combustion engine.

3. The valve according to claim 1, wherein the orifice disk element includes a central base region, the base region having an opening geometry for a complete passage of a medium to be sprayed out, the seat region being adjacent to the base region in a radially outward manner, the seat region being a peripheral annular region.

4. The valve according to claim 3, wherein the seat region extends in a frustoconical tapering manner downstream to the base region.

5. The valve according to claim 3, wherein the orifice disk element further includes a guidance region guiding the valve closure element on the orifice disk element.

6. The valve according to claim 5, wherein the base region, the seat region and the guidance region are shaped to form an inner cup of the orifice disk element.

7. The valve according to claim 5, wherein the guidance region extends in an annularly peripheral manner and an axially parallel manner.

8. The valve according to claim 5, wherein the guidance region is embodied simultaneously with a retaining region of the orifice disk element, the retaining region assisting the orifice disk element to be mounted in the valve.

9. The valve according to claim 6, wherein the orifice disk element further includes a retaining region and a joining region, the retaining region forming an outer radial termination of the orifice disk element, the retaining region being joined to the guidance region via the joining region.

10. The valve according to claim 5, wherein the first sheet metal layer includes at least two flow openings, the first sheet metal layer facing the valve closure element in the guidance region.

11. The valve according to claim 10, wherein the at least two flow openings have an inclined shape with respect to the longitudinal valve axis so that a swirl component can be impressed upon a further medium flowing through the at least two flow openings.

12. The valve according to claim 10, wherein material regions of the first sheet metal layer, which is situated between the at least two flow openings, represent guide surfaces for guiding the valve closure element on the orifice disk element.

13. The valve according to claim 5, wherein the opening geometry is situated in the base region so that the at least one spray discharge opening, in the second sheet metal layer possesses at least a partial offset from an inlet opening in the first sheet metal layer, the first sheet metal layer being a layer which is closest to the valve closure element, the second sheet metal layer being a layer which is farthest away from the valve closure element.

14. A method for manufacturing a valve seat of a valve, comprising the steps of:

(a) providing at least two thin metal foils;

(b) providing identical opening geometries and auxiliary openings in each of the at least two metal foils;

(c) superimposing the at least two metal foils to manufacture a band, the band having a plurality of rounds;

(d) isolating the rounds; and (e) reshaping the rounds into an orifice disk element, the orifice disk element including at least a base region having the opening geometries and a seat region having the valve seat.

15. The method according to claim 14, wherein the valve is a fuel injection valve for a fuel injection system of an internal combustion engine.

16. The method according to claim 14, wherein step (b) includes the substep of providing flow openings into each of the at least two metal foils.

17. The method according to claim 16, wherein the opening geometries, the auxiliary openings and the flow openings are provided in each of the at least two metal foils using one of a punching procedure, a laser cutting procedure, an electrodischarge machining procedure and an etching procedure.

18. The method according to claim 14, wherein, in step (e), the rounds are reshaped using one of a deep drawing procedure and a cupping procedure using a deep drawing tool.

19. The method according to claim 14, wherein, in step (d), the rounds are isolated using a cutting tool in a deep drawing tool.

20. The method according to claim 14, further comprising the step of:

(f) after step (e), hardening the valve seat in the seat region.

21. A method for manufacturing a valve seat for a valve, comprising the steps of:

(a) providing at least two thin metal foils;

(b) introducing identical opening geometries and auxiliary openings in each of the at least two metal foils;

(c) superimposing the at least two metal foils;

(d) joining the at least two metal foils using a joining procedure to provide a band, the band having a plurality of rounds;

(e) isolating the rounds; and (f) reshaping the rounds into an orifice disk element, the orifice disk element including at least a base region having the opening geometries and a seat region having the valve seat.

22. The method according to claim 21, wherein the valve is a fuel injection valve for a fuel injection system of an internal combustion engine.

23. The method according to claim 21, wherein step (b) includes the substep of providing flow openings into each of the at least two metal foils.

24. The method according to claim 23, wherein, in step (b), the opening geometries, the auxiliary openings and the flow openings are provided in each of the at least two metal foils using one of a punching procedure, a laser cutting procedure, an electrodischarge machining procedure and an etching procedure.

25. The method according to claim 21, wherein, in step (d), the at least two metal foils are joined using one of a welding procedure, a soldering procedure and an adhesive bonding procedure.

26. The method according to claim 21, wherein, in step (f), the rounds are reshaped using by one of a deep drawing procedure and a cupping procedure using a deep drawing tool.

27. The method according to claim 21, wherein, in step (e), the rounds are isolated using a cutting tool in a deep drawing tool.

28. The method according to claim 21, further comprising the step of:

(g) after step (f), hardening the valve seat in the seat region.

29. A valve comprising:

an orifice disk element having at least one spray discharge opening, the orifice disk element further having at least two sheet metal layers situated in a sandwich manner against one another, the orifice disk element having a seat region with an angled cross-section that forms a fixed valve seat; and a valve closure element cooperating with the valve seat and being axially movable along a longitudinal valve axis of the valve.

30. The valve of claim 29 wherein the valve closure element cooperates with a face of a first sheet metal layer from the at least two sheet metal layers.

31. The valve of claim 30 wherein the face of the first sheet metal layer extends from the seat region to a guidance region.

* * * * *